US008170453B2

(12) United States Patent
Akedo

(10) Patent No.: US 8,170,453 B2
(45) Date of Patent: May 1, 2012

(54) DEVELOPING DEVICE HAVING DEVELOPING ROLLER WITH SLEEVE HAVING AIR PERMEABILITY AND SUCKING DEVICE FOR SUCKING AIR FROM INSIDE THE SLEEVE AND IMAGE FORMING APPARATUS HAVING THE DEVELOPING DEVICE

(75) Inventor: Shuichi Akedo, Sakai (JP)

(73) Assignee: Sharp Kabushiki Kaisha, Osaka (JP)

( * ) Notice: Subject to any disclaimer, the term of this patent is extended or adjusted under 35 U.S.C. 154(b) by 423 days.

(21) Appl. No.: 12/412,016

(22) Filed: Mar. 26, 2009

(65) Prior Publication Data

US 2009/0245888 A1 Oct. 1, 2009

(30) Foreign Application Priority Data

Mar. 27, 2008 (JP) ..... P2008-085046

(51) Int. Cl.
*G03G 15/09* (2006.01)

(52) U.S. Cl. ..... 399/276; 399/94

(58) Field of Classification Search ..... 399/92–94, 399/98, 99, 267, 276, 277, 286
See application file for complete search history.

(56) References Cited

U.S. PATENT DOCUMENTS 4,570,572 A * 2/1986 Robinson et al.
4,959,691 A * 9/1990 Satoh
2005/0100360 A1* 5/2005 Koshimura et al. ..... 399/94

FOREIGN PATENT DOCUMENTS

JP 2000250316 A * 9/2000
JP 2002-229330 A 8/2002
JP 2004-258258 A 9/2004
JP 2006-11275 A 1/2006
JP 2006-337908 A 12/2006

* cited by examiner

*Primary Examiner* — David Porta
*Assistant Examiner* — Milton Gonzalez
(74) *Attorney, Agent, or Firm* — Birch, Stewart, Kolasch & Birch, LLP

(57) ABSTRACT

A sleeve constituting a developing roller of a developing device has a cylindrical body with three layers composed of a base layer having rigidity and formed in a mesh-like shape, a filter layer for blocking toner passage, and a conductive layer to which a developing bias voltage is applied, which are arranged in this order from the inside. When a sucking device sucks from an open end of one end portion of the sleeve, an air flow going from the inside of the developing roller through the open end to outside is generated so that a pressure of the internal space of the developing roller becomes smaller compared with the outside. As the peripheral wall has air permeability in its thickness direction, air flows from the outer circumferential portion of the developing roller through the peripheral wall to the inside of the developing roller.

8 Claims, 10 Drawing Sheets

DEVELOPING DEVICE HAVING DEVELOPING ROLLER WITH SLEEVE HAVING AIR PERMEABILITY AND SUCKING DEVICE FOR SUCKING AIR FROM INSIDE THE SLEEVE AND IMAGE FORMING APPARATUS HAVING THE DEVELOPING DEVICE

CROSS-REFERENCE TO RELATED APPLICATION

This application claims priority to Japanese Patent Application No. 2008-085046, which was filed on Mar. 27, 2008, the contents of which are incorporated herein by reference in its entirety.

BACKGROUND OF THE INVENTION

1. Field of the Invention

The present invention relates to a developing device and an image forming apparatus.

2. Description of the Related Art

An image forming apparatus of an electrostatic photographic system generally forms an image by executing steps of charging, exposure, development, transfer, cleaning, charge erasure, and fixing. In the forming step, for example, a photoreceptor drum driven to rotate has its surface uniformly charged by a charging device and the surface of the photoreceptor is irradiated with laser light by an exposure device so that an electrostatic latent image is formed on the surface of the photoreceptor charged. Subsequently, latent image formed on the surface of the photoreceptor is developed by a developing device and a toner image is formed on the surface of the photoreceptor. And then, by a transferring device, the toner image on the photoreceptor is transferred onto a member to be transferred. After that, due to the pressure and heating by a fixing section, the toner image transferred onto the to-be-transferred member is fixed thereto. Further, in a cleaning device, a residual toner remaining on the surface of the photoreceptor is removed and collected in a predetermined collecting section. Moreover, in an electricity removing device, residual charges on the surface of the photoreceptor after cleaning are removed, thereby preparing for next image formation.

As a developer for developing the electrostatic latent image formed on a surface of the photoreceptor, a one-component developer formed of a toner only, and a two-component developer composed of a toner and a carrier are commonly used. Although the one-component developer is advantageous in that the developing section can be of a simple structure with no need of an agitating mechanism or the like for mixing the toner and the carrier evenly since the one-component developer contains no carrier, the one-component developer has disadvantages such that stabilization of charge amount of the toner is not easy. Although the two-component developer is disadvantageous in that the developing section has a complicated structure with a need for an agitating mechanism or the like for mixing the toner and the carrier evenly, the two-component developer is often used for a high-speed image forming apparatus and a color image forming apparatus since the toner is stably charged.

As a developing device in which a two-component developer is generally used is a developing device including a developing tank, a developing roller, an agitating member, a regulating member, a chute, and the like. The developing tank supports the developing roller and the agitating member so as to rotate freely and contains a developer therein. The developing roller rotates with a developer layer borne on the surface thereof, and supplies toner to an electrostatic latent image on the surface of a photoreceptor to form a toner image. The agitating member uniformly agitates the developer in the developing tank to feed toward the developing roller. The regulating member regulates layer thickness of the developer layer on the surface of the developing roller.

In the two-component developer, in order to correspond to increase in printing speed, colorization, and further energy saving, a particle diameter and a softening point of toner are being reduced, and such toner has a drawback of being aggregated by heat easily. Accordingly, when a temperature in the developing device increases due to frictional heat in agitation in the developing device, a temperature of the developer increases to cause a problem that a toner aggregate is generated and fluidity of the developer is deteriorated to generate unevenness of an image density. In particular, there is a problem that no air flow is generated inside the developing roller and heat is likely to be filled therein so that a temperature gradually increases due to long-time use.

Against this problem, for example, in a developing device described in Japanese Unexamined Patent Publication JP-A 2002-229330, a passage for communication in an axial direction is provided in a developing roller, into which air is sent by a blowing section, and the sent air is guided to an inner circumferential surface of the developing roller by a spiral member to thereby enhance cooling efficiency of the developing roller.

However, since a developing roller for two-component developer has a plurality of magnets (magnet rollers) inside the developing roller in order to form a magnetic brush, it is difficult to secure a space for providing a spiral member in a passage, like the developing device of JP-A 2002-229330. In particular, in a miniaturized developing device, since a developing roller whose diameter is small is used, it is difficult to provide a spiral member with a sufficient width, thus cooling efficiency is not enhanced. As a result, it is impossible to sufficiently prevent deterioration in image quality such as image unevenness clue to increase in a temperature of the developer.

SUMMARY OF THE INVENTION

In view of the above mentioned problems, an object of the invention is to provide a developing device capable of providing high cooling efficiency even when a developing roller has a small diameter and suppressing increase in a temperature of the developer, and an image forming apparatus.

The invention provides a developing device comprising:

a sleeve having a cylindrical shape; and a multi-pole magnetic body composed of a plurality of magnets provided in an inside of the sleeve, the developing device developing an electrostatic latent image formed on a photoreceptor with a developer supplied on a surface of the sleeve by rotating the sleeve, a peripheral wall of the sleeve having air permeability in a thickness direction, and the developing device further comprising a sucking device that sucks air from the inside of the sleeve and forms air flow going from an outside of the sleeve through the peripheral wall to the inside of the sleeve.

According to the inventions a peripheral wall of the cylindrical sleeve has air permeability in a thickness direction, and a sucking device sucks air from the inside of the sleeve and forms air flow going from an outside of the sleeve through the peripheral wall to the inside of the sleeve.

Since air flows from an outer surface of the cylindrical sleeve and the air passes through the inside of the sleeve to be discharged from a side surface of the sleeve, it is possible to flow air efficiently into gaps between the multi-pole magnetic body and the magnets even when a gap between the sleeve and the multi-pole magnetic body is small, thus heat is not filled in the developing roller, and it is possible to provide high cooling efficiency even with a small-diameter developing roller and to suppress increase in temperature of the developer.

As a result, it is possible to prevent generation of a toner aggregate caused by increase in temperature of the developer and deterioration of fluidity of the developer, and to suppress generation of unevenness in density. Further, since air flows from a gap between the developing roller and the photoreceptor drum to the surface of the sleeve, an effect of collecting toner scattered with rotation of the developing roller is obtained by strengthening an air suction force of the sucking device.

Furthermore, In the invention, it is preferable that the sleeve includes a filter layer for blocking passage of toner and a conductive layer provided on a surface of the filter layer and having a gap.

According to the invention, the sleeve has a multiple-layer structure including a filter layer for blocking passage of toner and a conductive layer provided on a surface of the filter layer and having a gap.

Accordingly, it is possible to prevent a scattered toner particle from being adhered to the inside of the developing roller.

Furthermore, in the invention, it is preferable that the filter layer is composed of a porous member having a vent hole of 0.1 μm or more and 2 μm or less.

According to the invention, the filter layer is composed of a porous member having a vent hole of 0.1 μm or more and 2 μm or less.

In the case of less than 0.1 μm, a ventilation resistance in sucking air is increased, whereas in the case of exceeding 2 μm, a toner passes through the vent hole. Being within the range described above, it is possible to prevent a toner particle from flowing into the inside of the developing roller without deteriorating a sucking efficiency.

Furthermore, in the invention, it is preferable that the porous member is a porous polytetrafluoroethylene film.

According to the invention, the porous member is a porous polytetrafluoroethylene film.

Accordingly, even when friction with toner occurs, it is possible to prevent toner fusing and filming.

Furthermore, in the invention, it is preferable that the conductive layer has a vent hole whose width is 0.3 mm or more and 1 mm or less, and an opening ratio of the vent hole is 30% or more and 60% or less.

According to the invention, the conductive layer has a vent hole whose width is 0.3 mm or more and 1 mm or less, and an opening ratio of the vent hole is 30% or more and 60% or less.

In the case where the width of the vent hole is less than 0.3 mm, a developer including a carrier is likely to clog, whereas in the case of exceeding 1 mm, unevenness in image density is likely to be generated. Further, in the case where the opening ratio of the vent hole is less than 30%, a ventilation resistance in sucking air is increased, whereas in the case of exceeding 60%, unevenness in image density is likely to be generated.

Furthermore, in the invention, it is preferable that the conductive layer is composed of a conductive wire that is wound around an outer surface of the filter layer into a coil.

According to the invention, the conductive layer is composed of a conductive wire that is wound around an outer surface of the filter layer into a coil.

Accordingly, since the vent hole is formed along a rotational direction of the sleeve, it is possible to prevent a developer from being accumulated on an end of the vent hole.

Furthermore, in the invention, it is preferable that the sleeve has a base layer provided in an inside of the filter layer, the base layer having rigidity and being formed in a mesh-like shape.

According to the invention, the sleeve has a base layer provided in the inside of the filter layer, the base layer having rigidity and being formed in a mesh-like shape.

By providing the base layer having rigidity, even when the filter layer and the conductive layer have thin layer thickness, a sleeve with high rigidity is obtained and a stable image is obtained.

Furthermore, in the invention, it is preferable that an end portion of the sleeve comes into contact with an inside of a through hole provided in a wall of a developing tank via a bearing, and the sucking device is adapted to suck air from the inside of the sleeve through the end portion of the sleeve to an outside of the developing tank.

According to the invention, an end portion of the sleeve comes into contact with an inside of a through hole provided in a wall of a developing tank via a bearing. The sucking device is adapted to suck air from the inside of the sleeve through the end portion of the sleeve to an outside of the developing tank.

Accordingly, it is possible to discharge air in the inside of the developing roller directly to the outside of the developing tank, thus making it possible to simplify the sucking device.

Furthermore, the invention provides an image forming apparatus comprising:

a photoreceptor on a surface of which an electrostatic latent image is to be formed;

a charging device for charging the surface of the photoreceptor;

an exposure device for forming the electrostatic latent image on the surface of the photoreceptor;

the above-mentioned developing device for supplying toner to the electrostatic latent image formed on the surface of the photoreceptor to from a toner image;

a transfer device for transferring the toner image formed on the surface of the photoreceptor to a recording medium;

a cleaning device for cleaning the surface of the photoreceptor; and a fixing device for fixing the toner image to the recording medium.

According to the invention, an image forming apparatus comprising the developing device mentioned above is provided.

Accordingly, it is possible to suppress increase in temperature of the developer, prevent generation of a toner aggregate caused by increase in temperature of the developer and lowering of fluidity of the developer, and prevent deterioration in image quality such as image unevenness sufficiently.

BRIEF DESCRIPTION OF THE DRAWINGS

Other and further objects, features, and advantages of the invention will be more explicit from the following detailed description taken with reference to the drawings wherein.

DETAILED DESCRIPTION OF THE INVENTION

Figure 1:
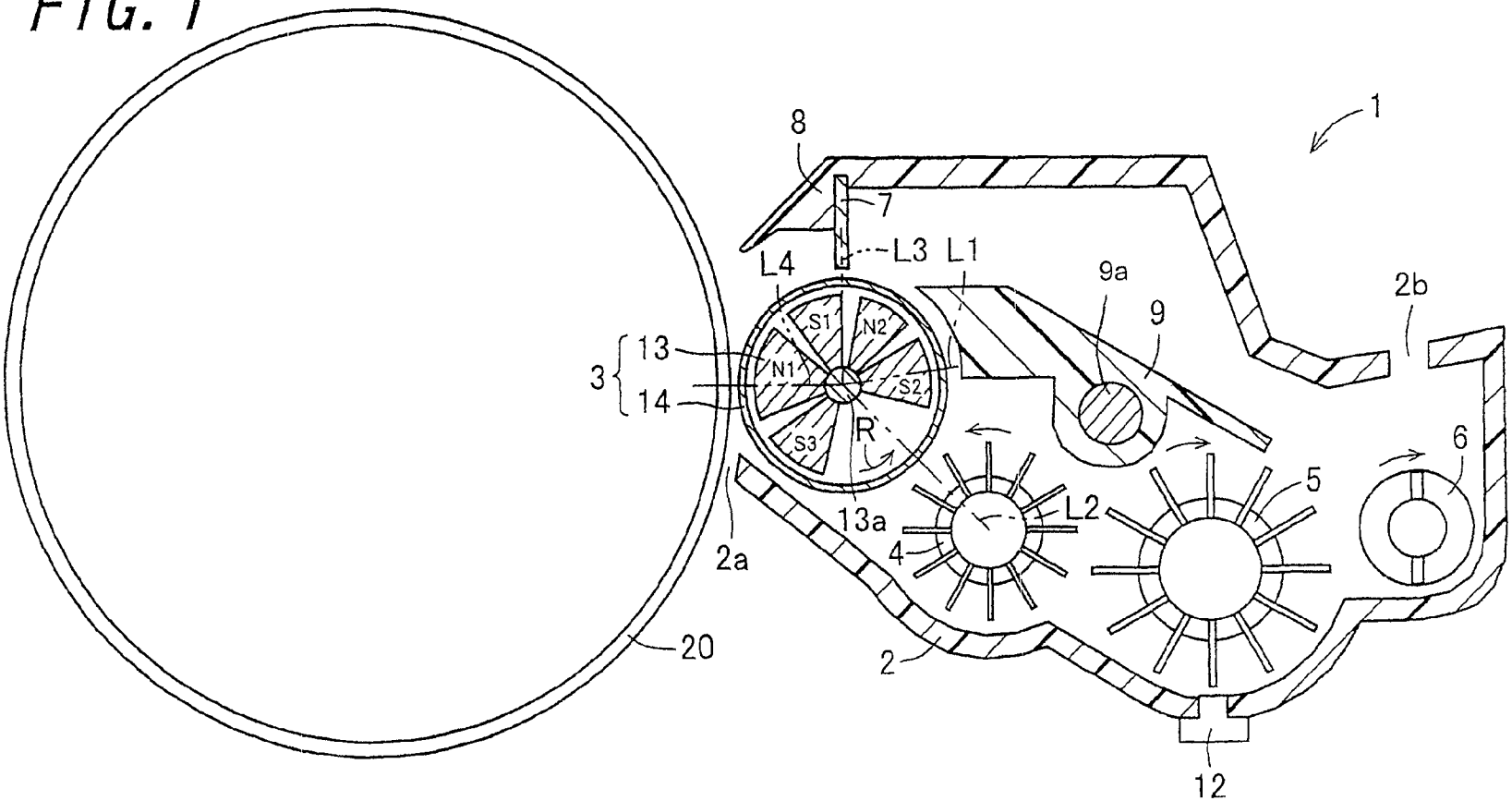
FIG. 1 is a schematic view showing the structure of a developing device according to an embodiment of the invention.

Now referring to the drawings, preferred embodiments of the invention are described below.

Prior to description for a developing roller of the invention, the structure of a developing device that contains the developing roller will be described.

FIG. 1 is a schematic view showing the structure of a developing device 1 according to an embodiment of the invention. The developing device 1 includes a developing tank 2, a developing roller 3, a first agitating member 4, a second agitating member 5, a transporting member 6, a regulating member 7, a cover member 8, a chute 9, and a toner density detecting sensor 12.

The developing tank 2 is a substantially rectangular column-shaped container member having an internal space, and supports the developing roller 3, the first agitating member 4, the second agitating member 5, and the transporting member 6 so as to rotate freely about axial lines which are parallel to one another, and supports directly or indirectly the regulating member 7, the chute 9, and the like to contain a developer. The developer is a two-component developer including a toner and a carrier as a magnetic body powder. Moreover, in a state where the developing device 1 is mounted to a main body of an electrophotographic image forming apparatus (not shown), the developing tank 2 has an opening 2*a* for development on the side surface facing a photoreceptor drum 20 in the image forming apparatus. A toner replenishment port 2*b* is also formed on the upper surface in a vertical direction of the developing tank 2.

A toner cartridge and a toner hopper (not shown) are provided in the vertical upper direction of the developing tank 2. More specifically, from the top to the bottom in the vertical direction, the toner cartridge, the toner hopper, and the developing tank 2 are provided in this order. The toner cartridge contains toner in an internal space thereof, and is provided so as to be detachable from the image forming apparatus main body (not shown) to which the developing device 1 is mounted.

Moreover, the toner cartridge is rotationally driven about an axis thereof by a driving section (not shown) provided in the image forming apparatus main body. In the side surface in a long-side direction of the toner cartridge, an elongated opening that extends in the long-side direction is formed, and a toner falls from the elongated opening with rotation of the toner cartridge to be supplied to the toner hopper.

The toner hopper is provided, for example, so that a toner supply port as an opening formed on the lower surface in the vertical direction and the toner replenishment port 2*b* as an opening formed on the upper surface in the vertical direction of the developing tank 2 communicate with each other in the vertical direction. In the toner hopper, a toner replenishing roller is provided in the vertical upper direction of the toner supply port. The toner replenishing roller is supported by the toner hopper so as to rotate freely, and is rotationally driven by a driving section (not shown). The rotational driving of the toner replenishing roller is controlled by a control unit (not shown) provided in the image forming apparatus, depending on a detection result of a toner density in the developing tank 2 from the toner density detection sensor 12. With the rotational driving of the toner replenishing roller, toner is replenished through the toner supply port and the toner replenishment port 2*b* into the developing tank 2.

The developing roller 3 is a roller-like member that has at least a part supported by the developing tank 2 so as to rotate freely and that is rotationally driven about an axis thereof by a driving section (not shown). Moreover, the developing roller 3 faces the photoreceptor drum 20 through the opening 2*a* of the developing tank 2. The developing roller 3 is provided so as to be spaced with a gap between the photoreceptor drum 20, and a closest portion is a developing nip portion. In the developing nip portion, toner is supplied from a developer layer on the surface of the developing roller 3 to an electrostatic latent image on the surface of the photoreceptor drum 20. At the developing nip portion, a developing bias voltage is applied from a power source connected to the developing roller 3 to the developing roller 3 so that toner is shifted from the developer layer on the surface of the developing roller 3 to the electrostatic latent image on the surface of the photoreceptor drum 20 smoothly.

Both the first agitating member 4 and the second agitating member 5 are roller-like members that are supported by the developing tank 2 so as to rotate freely and that are provided so as to be capable of rotationally driving about an axis thereof by a driving section (not shown). In the embodiments the first agitating member 4 rotates counterclockwise and the second agitating member 5 rotates clockwise. The first agitating member 4 faces the photoreceptor drum 20 through the developing roller 3 and is provided at a position in the vertical lower direction from the developing roller 3. In the embodiment, an installation angle of the first agitating member 4, that is an angle formed by a radius line L1 passing a position which indicates a peak of magnetic field of a magnetic pole S2 in a cross section surface of the developing roller 3 where the magnetic pole S2 is arranged, and a straight line L2 connecting the axis of the developing roller 3 and an axis of the first agitating member 4, is 54°. The second agitating member 5 faces the developing roller 3 through the first agitating member 4 and is provided at a position in the vertical lower direction from the developing roller 3. The first agitating member 4 and the second agitating member 5 agitate a developer contained in the developing tank 2 to apply an electric charge uniformly to toner, as well as pumps up the developer in the charged state to supply around the developing roller 3.

The transporting member 6 is a roller-like member that is supported by the developing tank 2 so as to rotate freely and that is provided so as to be capable of rotationally driving by a driving section (not shown). The transporting member 6 faces the first agitating member 4 through the second agitating member 5, and is provided in the vertical lower direction of the toner replenishment port 2*b*. The transporting member 6 transports toner replenished through the toner replenishment port 2*b* into the developing tank 2, around the second agitating member 5.

The regulating member 7 is a rectangular plate-like member extending in parallel to an axial direction of the developing roller 3, and has one end in a width direction perpendicular to a longitudinal direction supported by the developing tank 2 and the cover member 8 and the other end spaced with a gap between the surface of the developing roller 3, in the vertical upper direction of the developing roller 3. In the embodiment, the regulating member 7 is provided along a radial direction of the developing roller 3 (an extension line L3 of a radius of the developing roller 3) so that an angle formed by the extension line L3 and a radius line L4 passing a position which indicates a peak of magnetic field of a magnetic pole N1 in a cross section of the developing roller 3 where the magnetic pole N1 is arranged, is 90°. The regulating member 7 is formed by, for example, a non-magnetic metal having elasticity, such as stainless steel and aluminum, and synthetic resin. In the embodiment, for the regulating member 7, thin-plate stainless steel is used.

The cover member 8 supports the regulating member 7 with the developing tank 2. Specifically, one end in the width direction of the regulating member 7 and a vicinity portion thereof are supported so as to be held between the cover member 8 and the developing tank 2. The cover member 8 is formed by, for example, a material such as synthetic resin or a metal. In the embodiment, the cover member 8 is formed by synthetic resin. The regulating member 7 removes an excess developer from the developer layer borne on the surface of the developing roller 3 and regulates layer thickness of the developer layer so as to be constant to thereby adjust transport quantity of the developer. In addition, the regulating member 7 applies an electric charge to an insufficiently charged developer included in the developer layer by rubbing the other end in the width direction against the developer layer, to charge a developer included in the developer layer sufficiently. The cover member 8 prevents toner from scattering from a developer that has passed the regulating member 7 into the device.

The chute 9 is an elongated plate-like, member that is provided, in the developing tank 2, between the regulating member 7 and the first agitating member 4 in a rotational direction of the developing roller 3, and in the vertical upper direction of the first agitating member 4 and the second agitating member 5. The chute 9 has one end in its width direction perpendicular to its longitudinal direction that faces the surface of the developing roller 3 and is spaced with a gap therebetween, and has the other end extending in a direction away from the developing roller 3. In the embodiment, the upper surface in the vertical direction of the chute 9 is provided so as to be parallel to a horizontal direction at an end portion on the developing roller 3 side in the width direction of the chute 9 and a vicinity portion thereof, and so as to be lowered in the vertical lower direction as being away from the developing roller at other portions. The chute 9 is supported by a support member 9*a* formed so as to penetrate in the long-side direction of the chute 9 in the lower part in the vertical direction and be inserted into a through hole. By providing the chute 9, a developer in the developing tank 2 flows smoothly, and generation of non-uniform charging of toner, blocking of toner and the like are prevented. Specifically, although a developer removed from the surface of the developing roller 3 by the regulating member 7 temporarily retains in the space in the upper part of the developing roller 3, as the quantity thereof increases, a developer begins to flow in the direction away from the developing roller 3 on the upper surface in the vertical direction of the chute 9. The developer flows along the upper surface of the chute 9 and drops from an end portion in the opposite side to the side of the developing roller 3 in the width direction of the chute 9 toward the second agitating member 5. The dropped developer is uniformly mixed with another developer and a newly supplied developer by the first agitating member 4 and the second agitating member 5, and then transported to the developing roller 3.

The toner density detecting sensor 12 is mounted, for example, on the bottom of the developing tank 2 in the vertical lower direction of the second agitating member 5, and has a sensor surface provided so as to be exposed to the inside of the developing tank 2. The toner density detecting sensor 12 is electrically connected to a control unit (not shown). The control unit performs control so as to rotationally drive the toner cartridge depending on a detection result by the toner density detecting sensor 12 and replenish toner through the toner hopper into the developing tank 2. When the detection result by the toner density detecting sensor 12 is determined to be lower than a toner density setting value, a control signal is transmitted to a driving section for rotationally driving the toner cartridge to rotationally drive the toner cartridge. For the toner density detecting sensor, it is possible to use a general toner density detecting sensor, and examples thereof include a transmitting light detecting sensor, a reflection light detecting sensor, and a magnetic permeability detecting sensor. Among them, a magnetic permeability detecting sensor is preferable.

A power source (not shown) is connected to the magnetic permeability detecting sensor. The power source applies to the magnetic permeability detecting sensor a driving voltage for driving the magnetic permeability detecting sensor and a control voltage for outputting a detection result of a toner density to the control unit. Application of the voltage from the power source to the magnetic permeability detecting sensor is controlled by the control unit. The magnetic permeability detecting sensor is a sensor in a type of outputting a detection result of a toner density as an output voltage value upon application of the control voltage, and basically has excellent sensitivity for a vicinity of a center value of the output voltage, thus a control voltage to obtain an output voltage around that value is used to apply. This type of magnetic permeability detecting sensor is on the market, and examples thereof include TS-L, TS-A, and TS-K (all of them are products names, manufactured by TDK Corporation).

A control unit exclusive for the developing device 1 may be provided, or a control unit provided in the image forming apparatus to which the developing device 1 is mounted may be used as a control unit of the developing device. The control unit includes, for example, a storage section, a calculating section and a control section. Detection results from various sensors, setting values, image information, table data, programs, and the like are written into the storage section. As the storage section, it is possible to use one that is commonly used in this field, and examples thereof include a ROM (Read Only Memory), a RAM (Random Access Memory), and an HDD (Hard Disc Drive). The calculating section extracts various data (such as printing commands, detection results, and image information) input in the storage section and programs for executing various control, to perform various detection and/or determination. The control section transmits a control signal to the apparatus depending on a determination result from the calculating section to perform operational control. The control section and the calculating section are processing circuits realized by a microcomputer, microprocessor, and the like including a CPU (Central Processing Unit). The control unit includes a main power source with the storage section, the calculating section, and the control section.

With the developing device 1, a developer contained in the developing tank 2 is transported in the vertical upper direction of the first agitating member 4 with rotation of the first agitating member 4 and the second agitating member 5, and then taken up by a magnetic body of the developing roller 3 to be supplied to the surface of the developing roller 3. The developing roller 3 rotates with a developer layer borne on the surface thereof, and after undergoing layer thickness regulation for the developer layer by the regulating member 7 and charging of the developer, supplies toner to an electrostatic latent image on the photoreceptor drum 20 at the developing nip portion to develop.

After development, the developing roller 3 further rotates to be supplied with a developer again. On the other hand, a developer removed from the surface of the developing roller 3 by the regulating member 7 flows in the direction away from the developing roller 3 on the upper surface in the vertical direction of the chute 9, is returned to a gap between the second agitating member 5 and the transporting member 6, and then is mixed with another developer again to be transported toward the developing roller 3. In the developing tank 2, a developer circulates as described above. In addition, the transporting member 6 transports toner replenished in the developing tank 2 depending on a detection result by the toner density detecting sensor 12, around the second agitating member 5.

Figure 2:
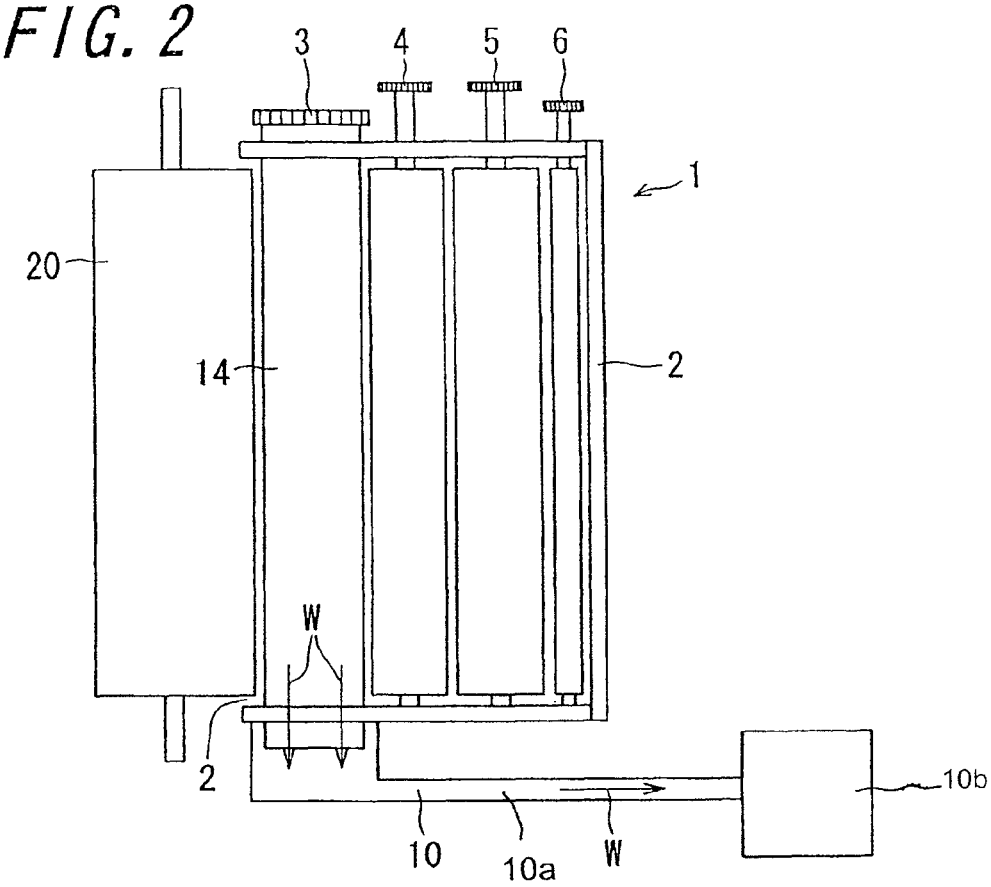
FIG. 2 is a plan view of the developing device when viewed from the top.

FIG. 2 is a plan view of the developing device 1 when viewed from the top. In order to describe the internal structure of the device, a state where the cover member B is removed is illustrated.

Note that, as shown in FIG. 1, the developing roller 3 includes a cylindrical sleeve 14 having air permeability and a multi-pole magnetic body 13 is disposed in an internal space thereof, which will be described below in detail. In the sleeve 14, one of two circular planes at the side has an opening through which air flows out from the inside, and the sleeve 14 comes into contact with insides of through holes having a wider diameter than that of the sleeve, which are provided in the side wall of the developing tank 2 via bearings, to be supported so as to rotate freely.

A sucking device 10 includes a sucking pump 10*b* and a sucking pipe 10*a* that has one end in close contact with the side wall of the developing tank 2 to cover the opening in the side of the sleeve 14 and the other end connected to the pump 10*b*, for sucking air in the developing roller 3. When the sucking device 10 sucks air, an air flow going from the outer circumferential surface of the sleeve 14 to the inside of the developing roller 3 is generated.

Figure 3:
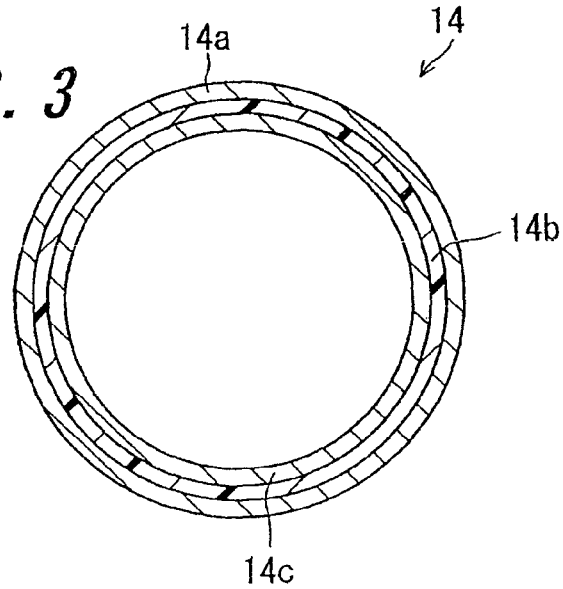
FIG. 3 is a cross-sectional view perpendicular to an axial direction of a sleeve.
Figure 4:
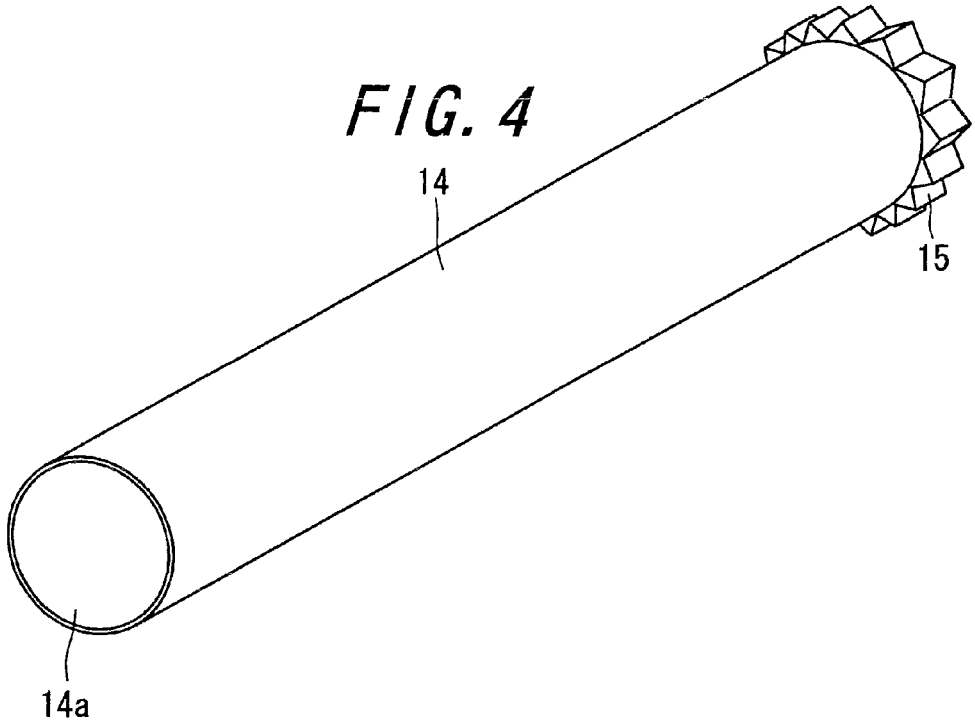
FIG. 4 is a perspective view schematically showing the sleeve.
Figure 5:
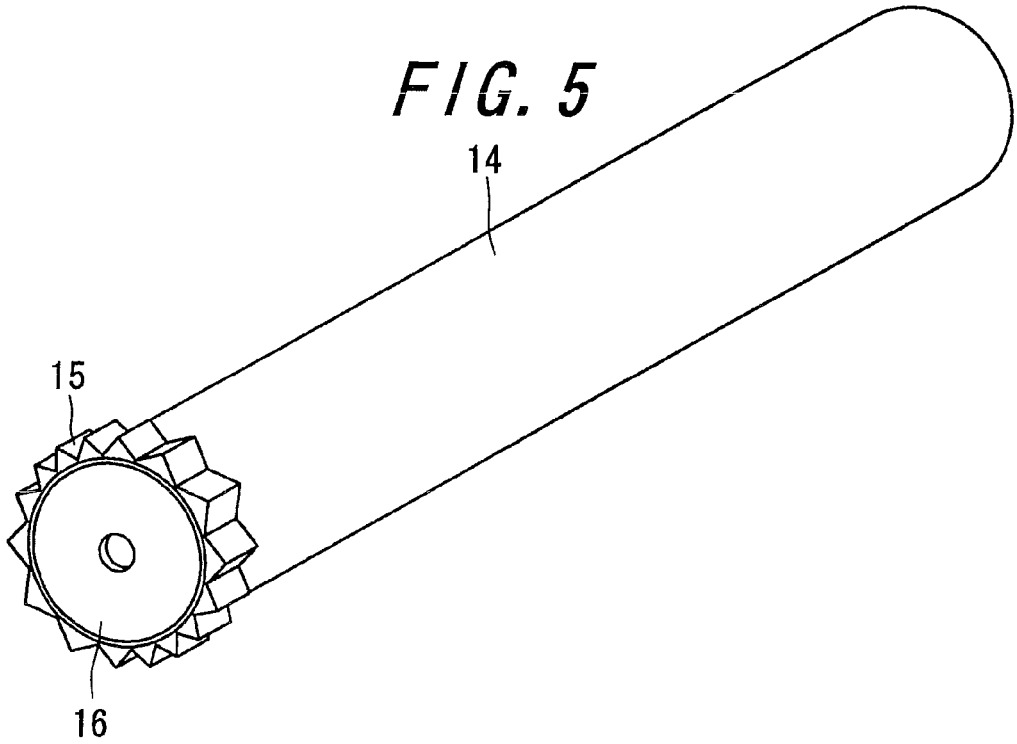
FIG. 5 is a perspective view of the sleeve when viewed from an opposite side to the case of FIG. 4.
Figure 6:
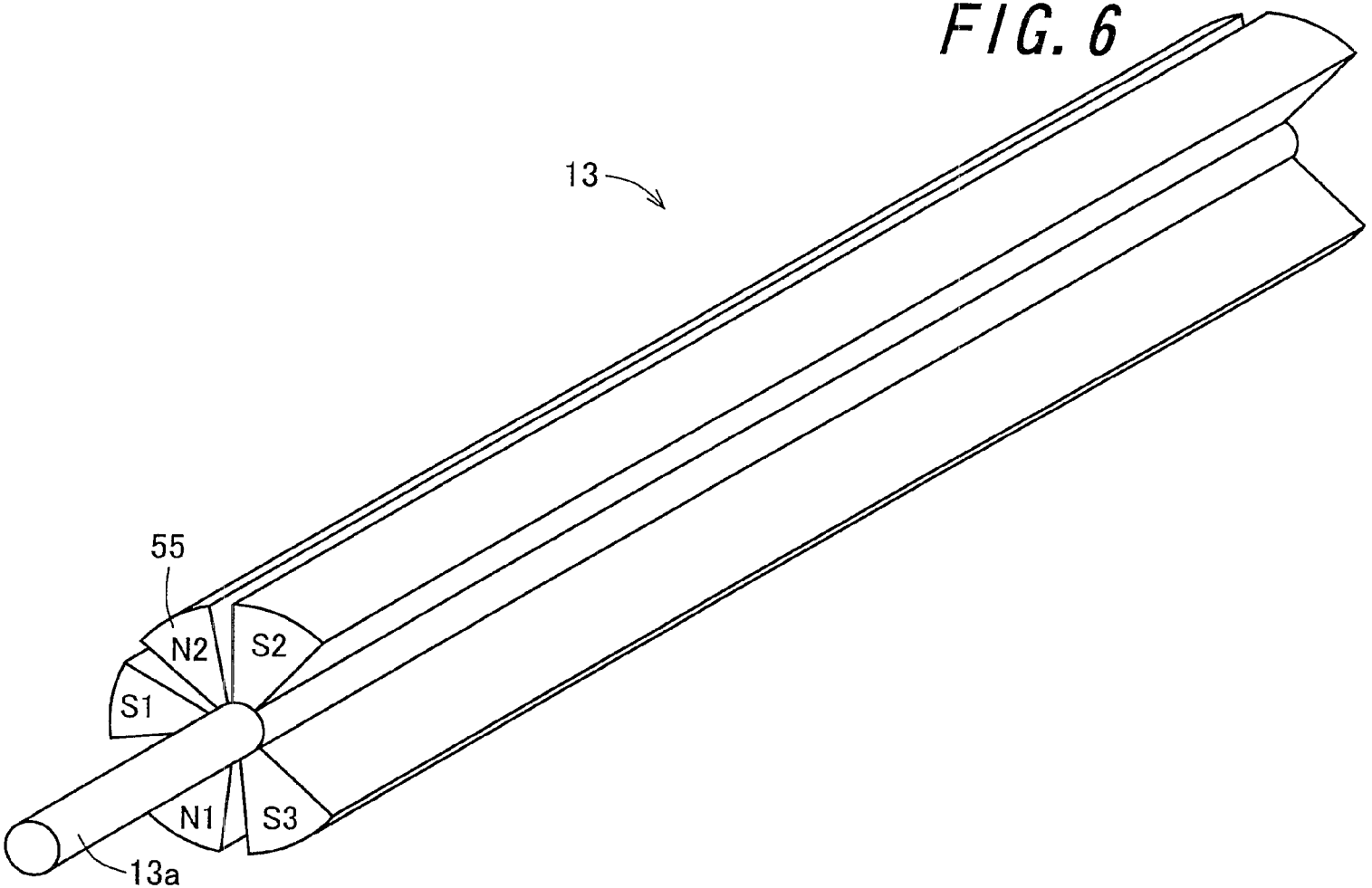
FIG. 6 is a perspective view schematically showing a multi-pole magnetic body constituting a developing roller.
Figure 7:
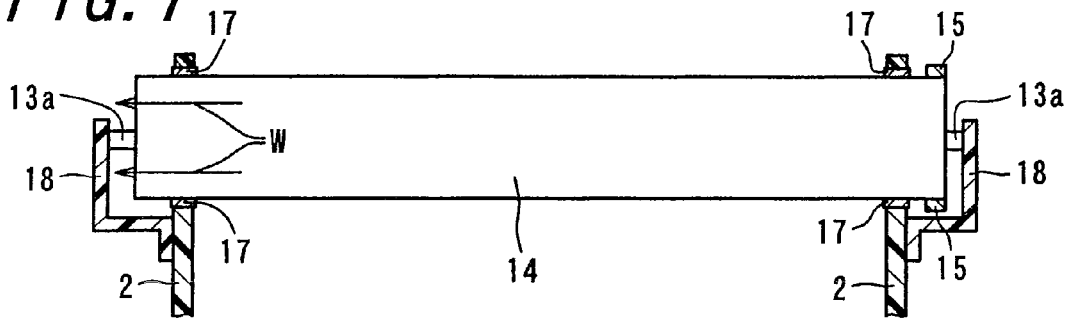
FIG. 7 is a cross-sectional view cut along a surface including an axis of the developing roller.

FIG. 3 is a cross-sectional view perpendicular to an axial direction of the sleeve 14. FIG. 4 is a perspective view schematically showing the sleeve 14, and FIG. 5 is a perspective view of the sleeve 14 when viewed from an opposite side to the case of FIG. 4. FIG. 6 is a perspective view schematically showing the multi-pole magnetic body 13 constituting the developing roller 3. FIG. 7 is a cross-sectional view cut along a surface including an axis of the developing roller 3.

The developing roller 3 includes the multi-pole magnetic body 13 and the sleeve 14. As shown in FIG. 6, the multi-pole magnetic body 13 has a cross section cut along a surface perpendicular to an axis thereof, in which a plurality of fan-shaped bar magnets 55 as magnetic poles N1 and N2 and magnetic poles S1, S2, and S3 are radially disposed in a multi-pole magnetic body shaft core 13*a* so as to be spaced one another. Each of the magnetic poles is provided in the order of the magnetic pole N1, the magnetic pole S1, the magnetic pole N2, the magnetic pole S2, and the magnetic pole S3 in an opposite direction to a rotational direction of the developing roller 3 (sleeve 14). The multi-pole magnetic body shaft core 13*a* is supported by multi-pole magnetic body holding members 18 provided in the tank wall of the developing tank 2 so as not to rotate.

The sleeve 14 is formed into a cylindrical shape with air-permeability, that is made of a non-magnetic material. One end portion of end portions of the sleeve 14 perpendicular to an axis thereof has open end, and is coupled to the sucking pump 10*b* through the sucking pipe 10*a*. The open end is supported so as to rotate freely in the state of coming into contact with an inside of a through hole having a wider diameter than that of the sleeve, which is provided in the side wall of the developing tank 2 via a bearing 17.

The sleeve 14 has the other portion end closed with a cover 16 having a small-diameter hole as shown in FIG. 5, and a driving gear 15 is disposed on an outer circumferential surface of the other end portion. As shown in FIG. 7, the sleeve 14 comes into contact with the insides of through holes provided in the tank wall of the developing tank 2 via the bearings 17, and includes the driving gear 15 at the circumferential surface of the sleeve exposed to the outside of the developing tank 2, so as to be rotationally driven when an external rotational driving force is transmitted to the driving gear 15. The multi-pole magnetic body shaft core 13*a* is fixed to the developing tank 2 by the multi-pole magnetic body holding members 18.

As shown in FIG. 3, the sleeve 14 has a cylindrical body with three layers composed of a base layer 14*c* having rigidity and formed in a mesh-like shape, a filter layer 14*b* for blocking toner passage, and a conductive layer 14*a* to which a developing bias voltage is applied, which are arranged in this order from the inside.

For the three-layer structured cylindrical body, a material of each layer is selected so that a peripheral wall thereof has air-permeability in a thickness direction from the conductive layer 14*a* of the outermost layer to the base layer 14*c* of the innermost layer.

As the sleeve 14 has air permeability in a thickness direction of the cylindrical body, by sucking with the sucking device 10 from the open end of one end of the sleeve 14, an air flow going from the inside of the developing roller 3 through the open end to the outside is generated so that a pressure of an inner space of the developing roller 3 becomes smaller compared with the outside. As the peripheral wall has air permeability in a thickness direction, air flows from the outer circumferential portion of the developing roller 3 through the peripheral wall into the developing roller 3.

While the sucking device 10 continues sucking, air flowing through the peripheral wall of the developing roller 3 also continues, thus generating an air flow continuously.

Since the air flow makes it possible to flow air efficiently to gaps between magnets of the multi-pole magnetic body 13, heat is not filled in the inside of the developing roller 3 and it is possible to provide high cooling efficiency even with the small-diameter developing roller 3 and suppress increase in temperature of the developer.

As a result, it is possible to prevent generation of a toner aggregate caused by temperature increase in the developer and deterioration of fluidity of the developer, and to suppress generation of unevenness in density. Further, since air flows from a gap between the developing roller 3 and the photoreceptor drum 20 to the surface of the sleeve 14, an effect of collecting scattered toner with rotation of the developing roller 3 is obtained by strengthening a suction force for the air.

Figure 9:
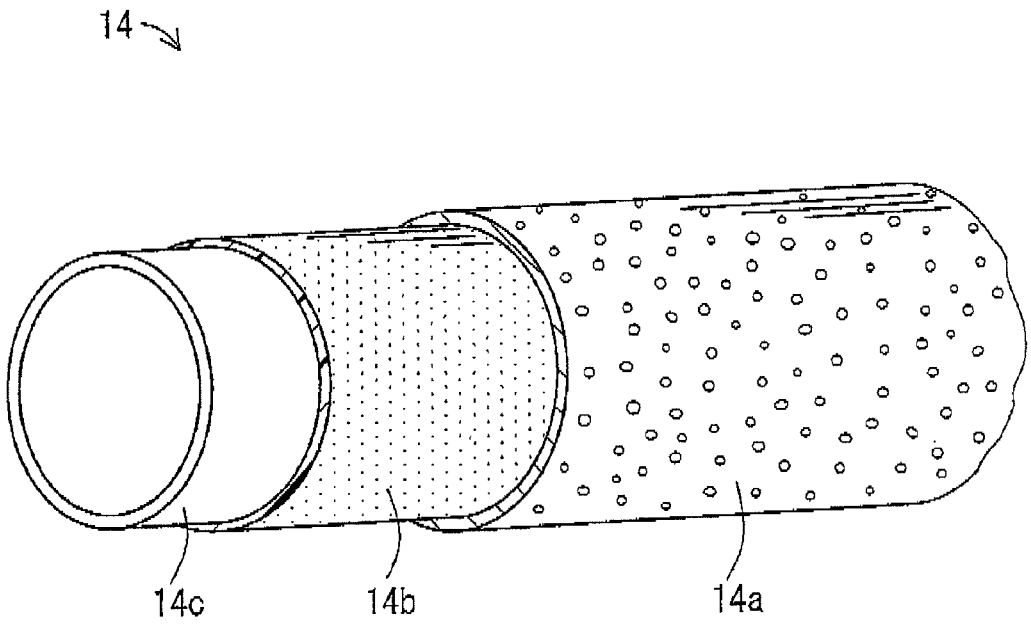
FIG. 9 is a perspective view of an example of a sleeve.

As the filter layer 14*b*, it is possible to use a porous material, as shown in FIG. 9, that blocks passage of toner on the surface of the sleeve 14 and allows only air to pass therethrough. A size of a vent hole is preferably 0.1 μm or more and 2 μm or less so that toner does not pass through the vent hole and a ventilation resistance becomes small. In the case of less than 0.1 μm, a ventilation resistance in sucking air is increased, whereas in the case of exceeding 2 μm, a toner passes through the vent hole.

As such a material, a well-known porous polytetrafluoroethylene film is preferable. Although a porous polytetrafluoroethylene film is generally used as a dust-collecting filter in a production facility of toner, when used for the sleeve where friction with toner occurs, it is possible to prevent toner fusing and filming.

A material of the conductive layer 14*a* is not particularly restricted as far as it is a conductive material having a vent hole as shown in FIG. 9, however, since the conductive layer 14*a* is a layer affecting development to the photoreceptor drum 20 due to being the outermost layer, it is necessary to select a material that causes no deterioration in image quality.

A width of the vent hole is preferably 0.3 mm or more and 1 mm or less. In the case of less than 0.3 mm, a developer including a carrier is likely to clog, whereas in the case of exceeding 1 mm, unevenness in image density is likely to be generated. Further, an opening ratio of the vent hole is preferably 30% or more and 60% or less. In the case of less than 30%, a ventilation resistance in sucking air is increased, whereas in the case of exceeding 60%, unevenness in image density is likely to be generated.

Figure 10:
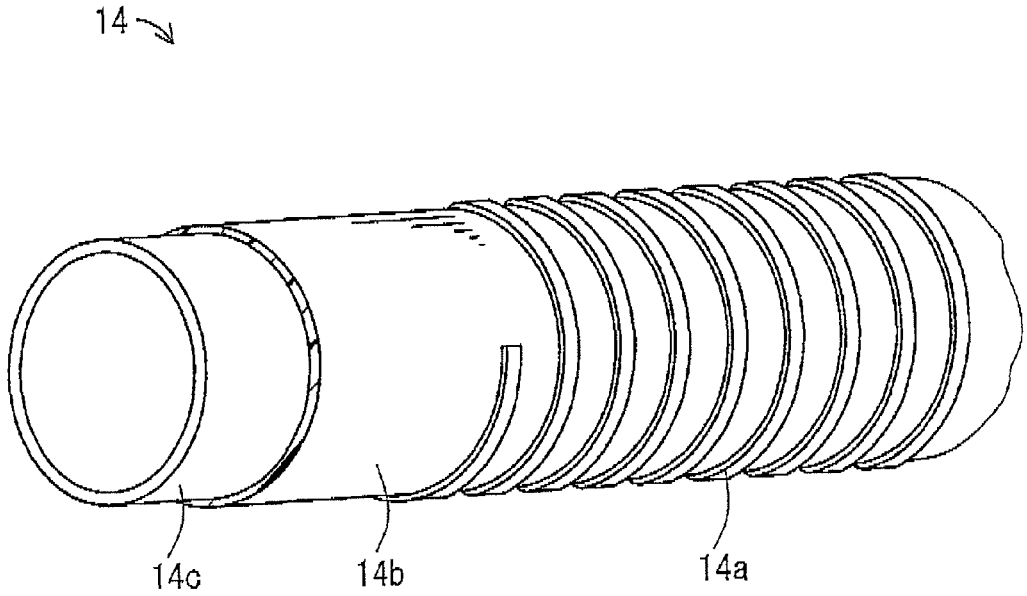
FIG. 10 is a perspective view of another example of a sleeve.

The conductive layer 14*a* may not use an integral layered member, and may employ the structure where a conductive wire made of a non-magnetic material is wound around the surface of the filter layer 14*b* into a coil as shown in FIG. 10, with a width of 0.3 mm or more and 1 mm or less. With this structure, continuous vent holes are obtained in a rotational direction, thus making it possible to reduce clogging of the developer at the vent holes.

Figure 11:
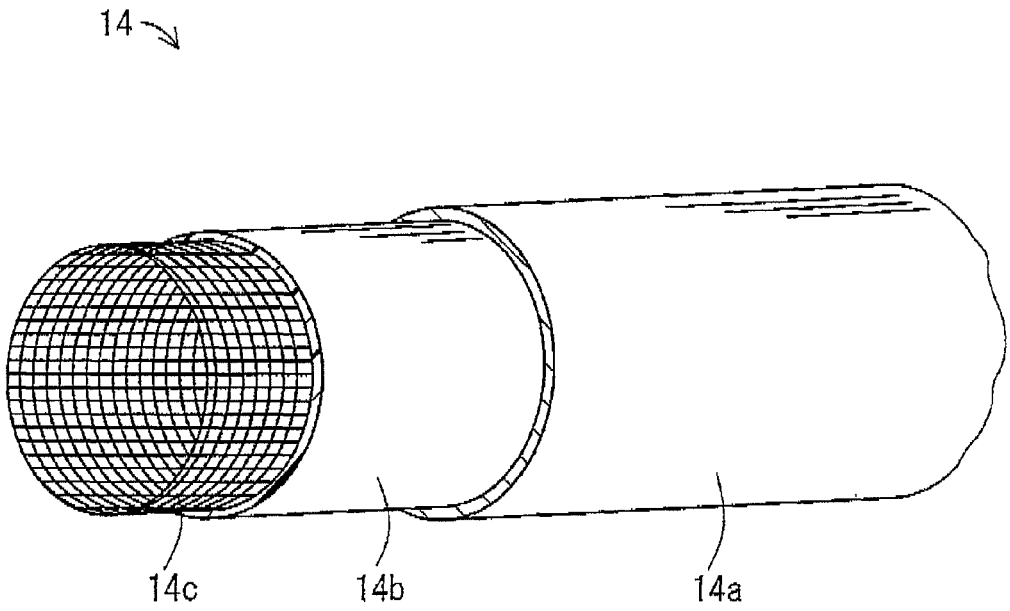
FIG. 11 is a perspective view of yet another example of a sleeve.

The base layer 14*c* is not particularly restricted as far as it is a material formed in a mesh-like shape, as shown in FIG. 11, that has air permeability and provides rigidity to the sleeve 14.

A size of the vent hole (mesh) is preferably 1 mm or more and 5 mm or less. In the case of less than 1 mm, a ventilation resistance is increased, whereas in the case of exceeding 5 mm, sufficient rigidity is not maintained.

As such a material, it is possible to use a porous aluminum tube.

When the sleeve 14 has the structure as described above, air is taken from the peripheral wall of the sleeve 14 to the inside, and is further discharged from the inside of the developing roller 3 through the end to the outside.

At this time, the sucking device 10 has a capability of sucking, for example, air of 0.05 to 1 litter for one minute. This generates flow of air sufficiently in the developing roller 3, thus making it possible to realize cooling of the developer.

The sucking device 10 may suck continuously or intermittently during development.

Figure 8:
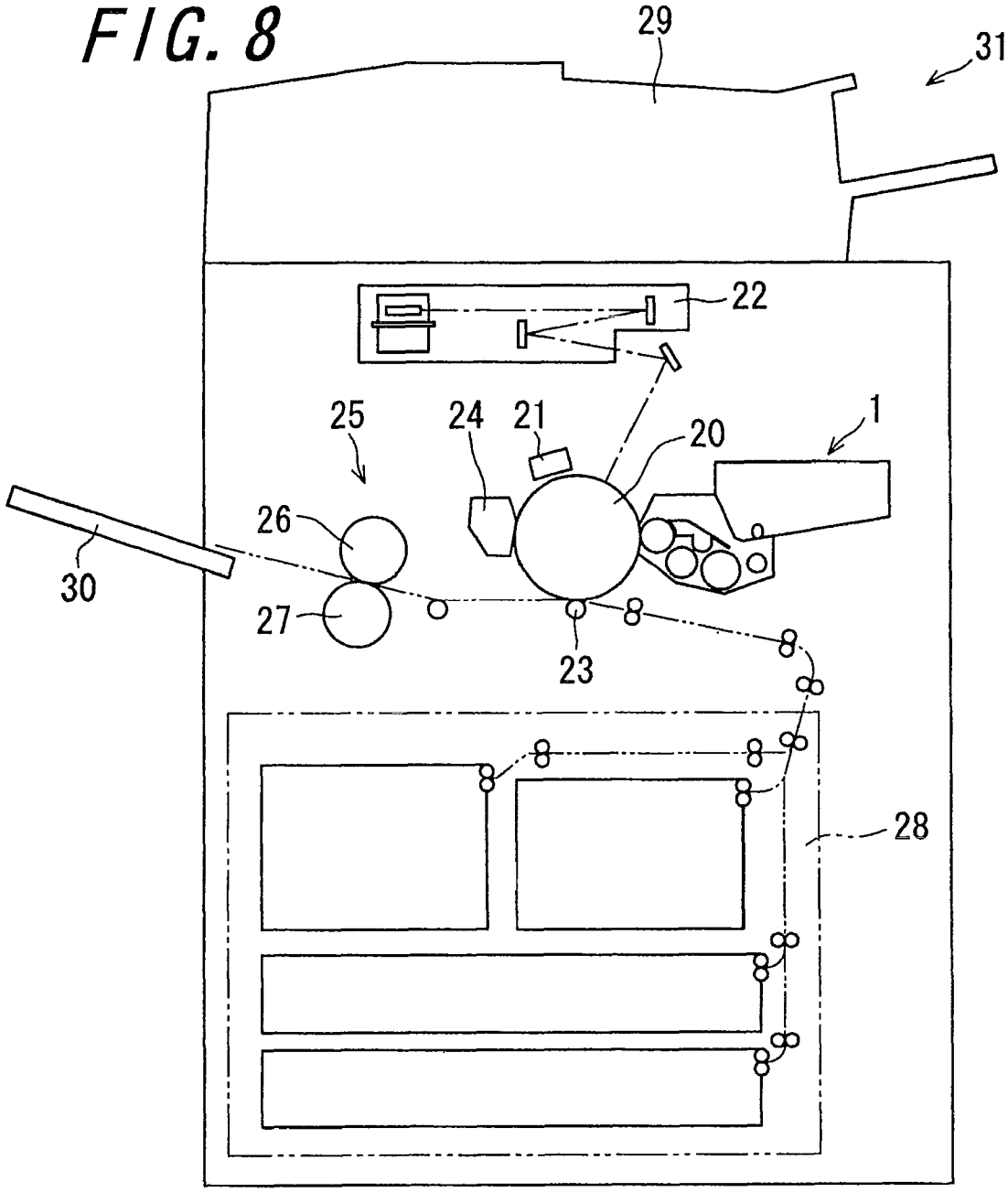
FIG. 8 is a cross-sectional view schematically showing the structure of an image forming apparatus including the developing device, according to another embodiment of the invention.

FIG. 8 is a cross-sectional view schematically showing the structure of an image forming apparatus 31 including the developing device 1, according to another embodiment of the invention.

The image forming apparatus 31 is a digital multifunctional peripheral that has a copy mode and a print mode. In the copy mode, in accordance with image information of a document read by a scanner section 29 described below, a copied object of the document is printed. In the print mode, in accordance with image information from an external device connected through a network to the image forming apparatus 31, an image corresponding thereto is printed. The image forming apparatus 31 includes a photoreceptor drum 20, a charging device 21, an exposure device 22, a developing device 1, a transfer device 23, a fixing device 25, a cleaning device 24, a paper feeding tray 28, the scanner section 29, and a catch tray 30.

The photoreceptor drum 20 is a roller-like member that is supported so as to be capable of rotationally driving about an axis thereof by a driving section (not shown) and that has, on the surface, a photosensitive layer on which an electrostatic latent image and then a toner image is formed. As the photoreceptor drum 20, it is possible to use, for example, a roller-like member that includes a conductive base (not shown) and a photosensitive layer (not shown) formed on the surface of the conductive base. As the conductive base, it is possible to use a conductive base formed like a cylinder, a column, a sheet, or the like, and among them, a cylindrical conductive base is preferable. The photosensitive layer is, for example, an organic photosensitive layer, an inorganic photosensitive layer, or the like.

The organic photosensitive layer is, for example, a laminate composed of a charge generating layer that is a resin layer containing a charge generating substance and a charge transporting layer that is a resin layer containing a charge transporting substance, a resin layer including the charge generating substance and the charge transporting substance in one resin layer, or the like. The inorganic photosensitive layer is, for example, a layer that contains one kind or two kinds or more selected from among zinc oxide, selenium, amorphous silicon, and the like. An undercoat layer may be interposed between the conductive base and the photosensitive layer, and a surface layer (protection layer) that mainly protects the photosensitive layer may be provided on the surface of the photosensitive layer.

The charging device 21 is a roller-like member provided so as to be brought into pressure-contact with the photoreceptor drum 20. A power source (not shown) is connected to the charging device 21 to apply a voltage to the charging device 21. With application of a voltage from the power source, the charging device 21 charges the surface of the photoreceptor drum 20 to a predetermined polarity and potential. In the embodiment, charger-type charging device is used, but it is also possible to use, a charging brush-type charging device, a roller-like charging device, a pin array charging device, an ion generator, a contact-type charging device such as a magnetic brush, or the like.

Upon input of image information of a document react by the scanner section 29 or image information from an external device, the exposure device 22 irradiates the charged surface of the photoreceptor drum 20 with signal light corresponding to the image information. Thereby, an electrostatic latent image corresponding to the image information is formed on the surface of the photoreceptor drum 20. A laser scanning device including a light source is used as the exposure device 22. The laser scanning device is a device combining, for example, a light source, a polygon mirror, an fθ lens, a reflection mirror, and the like. As the light source, it is possible to use, for example, a semiconductor laser, an LED array, an electroluminescence (EL) element, or the like.

The developing device 1 is the developing device 1 shown in FIG. 1.

The transfer device 23 is a roller-like member that is supported by a supporting section (not shown) so as to freely rotate, provided so as to be capable of rotating by a driving section (not shown), and provided so as to be brought into pressure-contact with the photoreceptor drum 20. As the transfer device 23, for example, a roller-like member including a metallic core bar having a diameter of 8 mm to 10 mm and a conductive elastic layer formed on the surface of the metallic core bar is used. As the metal that forms the metallic core bar, it is possible to use stainless steel, aluminum, or the like. As the conductive elastic layer, it is possible to use a rubber material obtained by mixing a conductive material such as carbon black to a rubber material such as ethylene-propylene diene rubber (EPDM), foamed EPDM, and foamed urethane. Recording mediums are supplied one by one from the paper feeding tray 28 through a pickup roller and registration rollers (not shown) to a pressure-contact portion (transfer nip portion) between the photoreceptor drum 20 and the transfer device 23, in synchronization with conveyance of a toner image with rotation of the photoreceptor drum 20.

Recording medium passes through the transfer nip portion, whereby the toner image on the surface of the photoreceptor drum 20 is transferred to the recording medium. A power supply (not shown) is connected to the transfer device 23 to apply a voltage of the opposite polarity to charging polarity of the toner constituting the toner image when the toner image is transferred to the recording medium. Thereby, the toner image is smoothly transferred to the recording medium. With the transfer device 23, the toner image on the surface of the photoreceptor drum 20 is transferred to the recording medium.

The cleaning device 24 includes a cleaning blade (not shown) and a toner storage tank (not shown). The cleaning blade is a plate-like member that extends in parallel to the long-side direction of the photoreceptor drum 20, and that is provided so that one end thereof in its width direction perpendicular to its longitudinal direction abuts on the surface of the photoreceptor drum 20. The cleaning blade removes toner, paper dust or the like remaining on the surface of the photoreceptor drum 20 after the toner image is transferred to the recording medium. The toner storage tank is a container-like member having an internal space, and temporarily stores toner removed by the cleaning blade. The surface of the photoreceptor drum 20 from which the toner image has been transferred is cleaned by the cleaning device 24.

The fixing device 25 includes a fixing roller 26 and a pressure roller 27. The fixing roller 26 is a roller-like member that is supported by a supporting member (not shown) so as to rotate freely and that is provided so as to be capable of rotating about an axis by a driving section (not shown). The fixing roller 26 has a heating member (not shown) inside, thereby heating toner constituting an unfixed toner image borne on the recording medium conveyed from the transfer nip portion, and fusing the toner to fix to the recording medium. As the fixing roller 26, for example, a roller-like member including a core bar and an elastic layer is used. The core bar is formed by metal such as iron, stainless steel and aluminum. The elastic layer is formed by an elastic material such as silicone rubber and fluorine rubber. The heating member generates heat by application of a voltage from a power source (not shown). As the heating member, it is possible to use a halogen lamp, an infrared lamp or the like.

The pressure roller 27 is a roller-like member that is supported so as to rotate freely and that is provided so as to be brought into pressure-contact with the fixing roller 26 by a pressure member (not shown). The pressure roller 27 is driven to rotate in accordance with rotation of the fixing roller 26. A pressure-contact portion between the fixing roller 26 and the pressure roller 27 is a fixing nip portion. At the time of heating and fixing of a toner image to a recording medium by the fixing roller 26, the pressure roller 27 presses a molten toner to the recording medium, thereby accelerating fixation of the toner image to the recording medium. As the pressure roller 27, it is possible to use a roller-like member having the same structure as the fixing roller 26. Also in the pressure roller 27, a heating member may be provided. As the heating member, it is possible to use a heating member same as the heating member in the fixing roller 26.

With the fixing device 25, the recording medium with the toner image transferred thereto is allowed to pass through the fixing nip portion, and a toner constituting the toner image is molten and pressed to the recording medium, whereby the toner image is fixed to the recording medium to print an image. The recording mediums with the images printed thereon are discharged by a conveying section (not shown) to the catch tray 30 provided in the vertical side face of the image forming apparatus 31, and then stacked.

The paper feeding tray 28 is a tray that stores recording mediums such as plain paper, coated paper, color copy paper, and OHP film. A plurality of paper feeding trays 28 are provided and each of the paper feeding trays 28 stores recording mediums of different size. The size of the recording mediums includes A3, A4, B5, and B4. Recording mediums of the same size may be also stored in the plurality of paper feeding trays 28. Recording mediums are fed sheet by sheet, in synchronization with conveyance of a toner image on the surface of the photoreceptor drum 20 to the transfer nip portion by a pickup roller, conveying rollers, and registration rollers (not shown).

The scanner section 29 is provided with a document set tray, a reversing automatic document feeder (RADF) (not shown), and the like, as well as provided with a document reading apparatus (not shown). The reversing automatic document feeder feeds a document placed on the document set tray to a document platen of the document reading apparatus. The document reading apparatus includes the document platen, a document scanning apparatus, a reflection member, a CCD (Charge Coupled Device) line sensor, and the like, and reads image information of a document placed on the document platen for every a plurality of lines, for example, 10 lines. The document platen is a plate-like glass member for placing a document whose image information is to be read. The document scanning apparatus includes a light source and a first reflection mirror (not shown), and reciprocates at a constant velocity V in parallel along the vertical lower surface of the document platen to irradiate the image forming surface of a document paled on the document platen with light. With irradiation of light, a reflection light image is obtained. The light source is a source of light to irradiate a document placed on the document platen. The first reflection mirror reflects the reflection light image toward the reflection member. The reflection member includes a second reflection mirror, a third reflection mirror, and an optical lens (not shown), and focuses the reflection light image obtained by the document scanning apparatus onto the CCD line sensor. The reflection member reciprocates at a velocity half of the velocity V following reciprocation of the document scanning apparatus. The second and third reflection mirrors reflect the reflection light image to guide the reflection light image toward the optical lens. The optical lens focuses the reflection light image onto the CCD line sensor. The CCD line sensor includes a CCD circuit (not shown) for performing photoelectric conversion of the reflection light image focused by the optical lens into an electric signal, and outputs the electric signal as image information to an image processing section in a control unit. The image processing section converts image information input from the document reading apparatus or an external apparatus such as a personal computer into an electric signal to output to the exposure device 22.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A developing device comprising:

a sleeve having a cylindrical shape; and a multi-pole magnetic body composed of a plurality of magnets provided in an inside of the sleeve, the developing device developing an electrostatic latent image formed on a photoreceptor with a developer supplied on a surface of the sleeve by rotating the sleeve, a peripheral wall of the sleeve having air permeability in a thickness direction, and the developing device further comprising a sucking device that sucks air from the inside of the sleeve and forms air flow going from an outside of the sleeve through the peripheral wall to the inside of the sleeve, wherein the sleeve includes a filter layer for blocking passage of toner and a conductive layer provided on a surface of the filter layer and having a gap.

2. The developing device of claim 1, wherein the filter layer is composed of a porous member having a vent hole of 0.1 μm or more and 2 μm or less.

3. The developing device of claim 2, wherein the porous member is a porous polytetrafluoroethylene film.

4. The developing device of claim 1, wherein the conductive layer has a vent hole whose width is 0.3 mm or more and 1 mm or less, and an opening ratio of the vent hole is 30% or more and 60% or less.

5. The developing device of claim 1, wherein the conductive layer is composed of a conductive wire that is wound around an outer surface of the filter layer into a coil.

6. The developing device of claim 1, wherein the sleeve has a base layer provided in an inside of the filter layer, the base layer having rigidity and being formed in a mesh-like shape.

7. The developing device of claim 1, wherein an end portion of the sleeve comes into contact with an inside of a through hole provided in a wall of a developing tank via a bearing, and the sucking device is adapted to suck air from the inside of the sleeve through the end portion of the sleeve to an outside of the developing tank.

8. An image forming apparatus comprising:

a photoreceptor on a surface of which an electrostatic latent image is to be formed;

a charging device for charging the surface of the photoreceptor;

an exposure device for forming the electrostatic latent image on the surface of the photoreceptor;

the developing device of claim 1, for supplying toner to the electrostatic latent image formed on the surface of the photoreceptor to from a toner image;

a transfer device for transferring the toner image formed on the surface of the photoreceptor to a recording medium;

a cleaning device for cleaning the surface of the photoreceptor; and a fixing device for fixing the toner image to the recording medium.

* * * * *